United States Patent [19]

Higuchi et al.

[11] Patent Number: 4,484,957

[45] Date of Patent: Nov. 27, 1984

[54] PERMANENT MAGNETIC ALLOY

[75] Inventors: Akira Higuchi, Osaka; Naoyuki Ishigaki, Shiga; Yutaka Matsuura; Hitoshi Yamamoto, both of Osaka, all of Japan

[73] Assignee: Sumitomo Special Metals Co., Ltd., Osaka, Japan

[21] Appl. No.: 411,276

[22] Filed: Aug. 25, 1982

Related U.S. Application Data

[63] Continuation-in-part of Ser. No. 231,316, Feb. 4, 1981, abandoned.

[30] Foreign Application Priority Data

Feb. 7, 1980 [JP] Japan ..... 55-14453

[51] Int. Cl.[3] ..... H01F 1/04

[52] U.S. Cl. ..... 148/31.57; 148/425; 148/426; 420/435; 420/455; 420/459; 75/123 E; 75/123 K; 75/125

[58] Field of Search ..... 148/408, 409, 425, 426, 148/31.57; 420/435, 455, 459; 75/125, 123 E, 123 K

[56] References Cited

U.S. PATENT DOCUMENTS

| | | | |
|---|---|---|---|
| 3,421,889 | 1/1969 | Ostertag et al. | 75/170 |
| 3,558,371 | 1/1971 | Becker | 148/31.57 |
| 3,560,200 | 2/1971 | Nesbitt et al. | 75/170 |
| 3,615,911 | 10/1971 | Nesbitt et al. | 75/170 |
| 3,839,102 | 10/1974 | Tawara et al. | 148/31.57 |
| 3,947,295 | 3/1976 | Tawara et al. | 148/31.57 |
| 3,950,194 | 4/1976 | Hirota et al. | 148/31.57 |
| 3,982,971 | 9/1976 | Yamanaka et al. | 148/31.57 |
| 3,998,669 | 12/1976 | Strnat | 148/31.57 |
| 4,047,982 | 9/1977 | Sagawa et al. | 148/101 |
| 4,081,297 | 3/1978 | Nagel et al. | 148/31.57 |
| 4,082,582 | 4/1978 | Menth et al. | 148/31.57 |
| 4,099,995 | 7/1978 | Menth et al. | 148/31.57 |
| 4,116,726 | 9/1978 | Menth et al. | 148/31.57 |
| 4,121,924 | 10/1978 | de Barbadillo | 75/123 E |
| 4,121,952 | 10/1978 | Senn | 148/31.57 |
| 4,131,495 | 12/1978 | Menth et al. | 148/31.57 |
| 4,135,953 | 1/1979 | Nagel et al. | 148/31.57 |
| 4,208,225 | 6/1980 | Kurz et al. | 148/31.57 |
| 4,222,770 | 9/1980 | Osumi et al. | 75/152 |
| 4,279,668 | 7/1981 | Kurz et al. | 148/31.57 |
| 4,284,440 | 8/1981 | Tokunaga et al. | 148/31.57 |

FOREIGN PATENT DOCUMENTS

| | | |
|---|---|---|
| 49-20020 | 2/1974 | Japan . |
| 49-13132 | 3/1974 | Japan . |
| 1266787 | 3/1972 | United Kingdom . |
| 1532185 | 11/1978 | United Kingdom . |
| 1564924 | 11/1980 | United Kingdom . |

OTHER PUBLICATIONS

Journal of Applied Physics, vol. 33, No. 5, (May 1962), "Magnetic Moments of Intermetallic Compounds of Transition and Rare Earth Elements", Nesbitt et al., pp. 1674–1678.

J. Phys. Chem. Solids, vol. 25, pp. 1069–1080, (1964), "The Crystal Structure and Magnetic Properties of Rare-Earth Nickel (RNi) Compounds", Abrahams et al.

IEEE Trans. on Magnetics, vol. MAG-2, No. 3, (Sep. 1966), "Magnetic Properties of Rare Earth Iron Intermetallic Compounds", Strnat et al.

*Primary Examiner*—John P. Sheehan

*Attorney, Agent, or Firm*—Burns, Doane, Swecker and Mathis

[57] ABSTRACT

A permanent magnetic alloy comprising of an intermetallic compound of rare earth elements and transition metals, shown by the formula:

$$R(Ni_xFe_yCo_{1-x-y-z}Cu_z)_A$$

wherein R is at least one selected from the lanthanide light rare earth elements including Y, such as Y, La, Ce, Pr, Nd and Sm, and $0.02 \leqq x \leqq 0.55$ $x/y = 0.07\text{–}25.0$ $0.01 \leqq y \leqq 0.65$ $0.02 \leqq z \leqq 0.30$ $6.0 < A < 8.0$ Preferably, the Ni and Fe are incorporated in substantially equimolar amounts.

19 Claims, 8 Drawing Figures

—— TbCu7 type crystal structure

—·— Th2Zn17 type crystal structure

----- CaCu5 type crystal structure

——— TbCu7 type crystal structure

—·— Th2Zn17 type crystal structure

------ CaCu5 type crystal structure

——— TbCu7 type crystal structure

—·— Th2Zn17 type crystal structure

- - - - CaCu5 type crystal structure

PERMANENT MAGNETIC ALLOY

CROSS-REFERENCE TO RELATED APPLICATION

This application is a continuation-in-part of parent copending application Ser. No. 231,316 filed on Feb. 4, 1981 abandoned. The entire disclosure of the parent application is incorporated herein by reference subject to the preference of the disclosure in this application hereinafter.

FIELD OF THE INVENTION

The present invention relates to a new permanent magnetic alloy containing a rare earth element, Ni, Fe, Co and Cu.

BACKGROUND OF THE INVENTION

Heretofore, many technical papers have been issued on magnetic alloys comprising rare earth elements and transition metals. Of the various alloys disclosed, an alloy comprising rare earth elements and cobalt has been considered particularly promising as permanent magnetic material. In fact, permanent magnets of the $RCo_5$ type and of the $R_2Co_{17}$ type are now in use.

However, as is well known in the art, it has experimentally been confirmed that intermetallic compounds and alloys of rare earth elements and Ni alone, or Fe alone, respectively, have no possiblity of being used as permanent magnetic material.

For example, E. A. Nesbitt et al "Journal of Applied Physics" Vol. 33, No. 5 May (1962) p. 1677 report on the temperature dependence of magnetic moment of intermetallic compounds and alloys of Ni and rare earth elements, such as $SmNi_5$, $PrNi_5$, $YNi_5$ etc.. According to this report, even for the $RNi_5$ type compound, which is crystal-structurally similar to the above mentioned $RCo_5$ type compound, magnetic moment is substantially zero over all the usual service temperature range. This means that this type of material has no possibility of being used as permanent magnetic material.

S. C. Abrahams et al "J. Phys. Chem. Solids" Pergamon Press (1964) Vol. 25 p. 1077 show data on Curie point, which is one of important properties of permanent magnetic material, with respect to a certain number of rare earth-nickel intermetallic compounds. According to this report, $LaNi_5$ and $CeNi_5$, for examle, possess Curie point fo 1.4° K. and $SmNi_5$ 25° K. at highest, the latter showing the highest among the reported Curie points for $RNi_5$. These temperatures are all below the ambient temperature. Thus, there is apparently no possibility that these materials may be used as permanent magnetic material at ambient temperatures.

K. Strnat et al "IEEE Trans. on Mag." Vol. MAG-2, No. 3, September 1966, pp. 489–493, under the title "Magnetic Properties of Rare Earth-Iron Intermetallic Compounds" report on physical properties essentially required as permanent magnetic material as to rare earth-iron alloys. It is, however, concluded that these alloys have no possibility of being used as permanent magnetic material, since the maximum Curie point for a series of alloys ranging from $RFe_7$ to $R_2Fe_{17}$ is 187° C. (that of $Gd_2Fe_{17}$).

Therefore, it has experimentally been affirmed hitherto in the prior art that alloys of rare earth elements with nickel or iron alone, respectively, cannot be used as permanent magnetic material.

Furthermore, there have been issued a number of patents on permanent magnetic alloys of rare earth elements and transition metals. For example, U.S. Pat. Nos. 3,421,889; 3,839,102; 3,947,295; 3,950,194; 3,982,971; 4,047,982; 4,081,297; 4,082,582; 4,099,995; 4,116,726; 4,121,952; 4,131,495; and 4,135,953. However, none of them have proposed the incorporation of nickel in these alloy systems. U.S. Pat. No. 3,560,200 (E. A. Nesbitt et al) discloses and claims RE-Co (and/or Fe)-Cu alloys and suggests that Cu may be partially or totally substituted with nickel or aluminium. However, it also states that it is clearly desirable to utilize as little as possible of copper, nickel and of aluminium, since it makes little magnetic contribution to the final composition at usual operating temperatures.

Thus, the prior art does not disclose and/or recognize anything about magnetic properties which will be obtained by incorporating both Ni and Fe in the rare earth-containing alloy system.

While we have found that particular compositions containing rare earth and (Fe+Ni) show excellent magnetic properties and other useful commercial properties, these alloys per se are not permanent magnetic in absence of addition of binder.

OBJECTS AND SUMMARY OF THE INVENTION

The primary object of the present invention is to provide permanent magnetic alloys containing cobalt and rare earth elements partially substituted with nickel and iron which are less expensive than presently available magnetic alloys of rare earth elements and cobalt.

Another object is to provide permanent magnetic alloys having improved magnetic properties compared with those of the present-used rare earth-cobalt alloy.

Still another object is to provide permanent magnetic alloys in which the Co is partially substituted by copper.

Further object is to provide a sintered permanent magnetic body composed of the alloys hereinabove mentioned.

Other objects of the present invention will become apparent in the following description and drawings.

The present invention provides a permanent magnetic alloy and a sintered permanent magnetic body, as well, comprising an intermetallic compound shown by the formula:

$$R(Ni_xFe_yCo_{1-x-y-z}Cu_z)_A$$

wherein R is at least one element selected from the group consisting of Y, La, Ce, Pr, Nd and Sm, and $0.02 \leqq x \leqq 0.55$
$x/y = 0.07-25.0$
$0.01 \leqq y \leqq 0.65$
$0.02 \leqq z \leqq 0.30$
$x+y+z<1$
$6.0<A<8.0$

DETAILED DESCRIPTION OF THE PREFERRED EMBODIMENTS

The inventors of the present invention have intensively studied the providing of rare earth element-transition metal permanent magnetic alloys, particularly permanent magnetic alloys of rare earths and the transition metals, nickel and iron, even though the possibility of the practical application, as a permanent magnetic alloy, of rare earth-Ni (or Fe) system alloys has been denied in the prior art.

The inventors have now found, notwithstanding the teachings of the prior art that nickel and iron are not desirable elements for providing rare earth element-based magnetic alloys with the requisite magnetic properties that a rare earth element-based magnetic alloy containing nickel and iron can possess satisfactory magnetic properties from a practical viewpoint when both the nickel and iron are added in particularly defined amounts. In our copending application Ser. No. 411,277, filed concurrently herewith which is a continuation-in-part application of a parent copending application Ser. No. 231,314, there is disclosed and claimed a ferromagnetic alloy composition having the general formula:

$$R(Ni_xFe_y)_A \quad (1)$$

wherein R is one or more of the lanthanide light rare earth elements La, Ce, Pr, Nd and Sm, and also including Y, or alloys thereof.

$0.35 \leqq x \leqq 0.55$
$x/y = 0.55-1.25$
$6.0<A<8.0$

Figure 7:
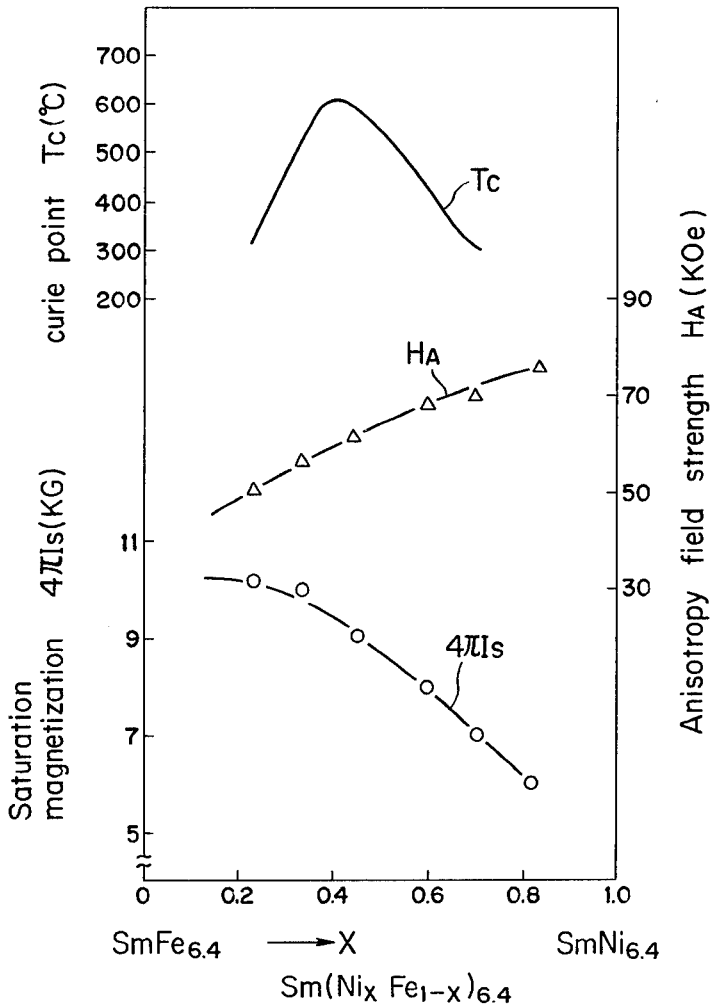
FIG. 7 is a graph showing saturation magnetization ($4\pi Is$—KG), anisotropy magnetic field strength ($H_A$—KOe) and Curie point (Tc—°C.) with respect of the alloy system of $Sm(Ni_xFe_{1-x})_{6.4}$ wherein x varies from zero to one.
Figure 8:
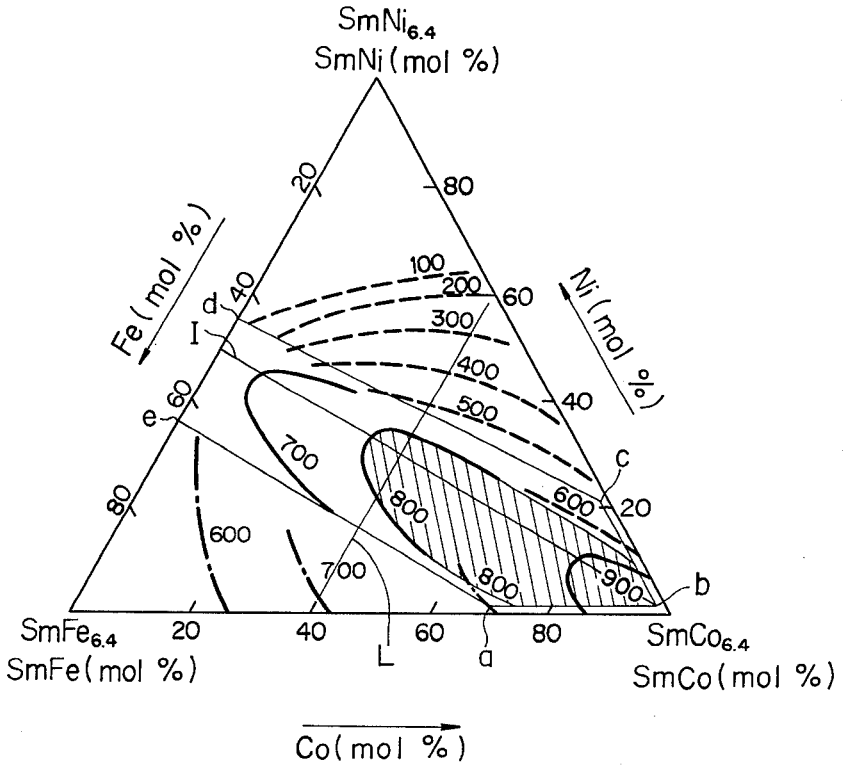
FIG. 8 is a graph depicted by supperposing FIG. 4 and FIG. 5, wherein the shaded area corresponds to the claimed scope and the line L represents a line taken along $Sm(Ni_{0.6}Co_{0.4})_{6.4}$-$Sm(Fe_{0.6}Co_{0.4})_{6.4}$.

The saturation magnetization strength (i.e., theoretically upper limit of the residual magnetization Br), anisotropy field strength (i.e., theoretically upper limit of the intrinsic coercive force iHc) and Curie point at which permanent magnetic properties are lost, which are important in evaluating the possibility that a certain material may be used as permanent magnetic material, were determined with respect to the alloy composition defined in formula (1). An alloy system $Sm(Ni_xFe_{1-x})6.4$ was measured with respect to the above three magnetic properties. The results are shown in FIG. 7 and summarized as follows:

| | |
|---|---|
| Within an x range | $0.35 \leqq x \leqq 0.55$ |
| Saturation magnetization strength | 8–10 KG |
| Anisotropy field strength | 50–70 KOe |
| Curie point ($TbCu_7$ type crystal structure) | 500° C. or higher |

These magnetic properties are due to the incorporation of both iron and nickel in the alloy system in approximately equimolar amounts and are sufficient to prove the possibility that this type of alloy can be used as permanent magnetic alloys. The inventors of the present invention have also found that these magnetic properties can further be improved or stabilized by adding a certain amount of Co to the alloy composition. This characteristic feature of this alloy composition which is disclosed and claimed in our copending application Ser. No. 411,277, filed concurrently herewith which is a continuation-in-part application of a parent copending application Ser. No. 231,314 can be expressed as follows:

$$R(Ni_xFe_yCo_{1-x-y})_A \quad (2)$$

wherein R is one or more of the lanthanide light rare earth elements La, Ce, Pr, Nd and Sm, as well as Y, or alloys thereof and $0.02 \leqq x \leqq 0.55$
$x/y = 0.07-25.0$
$0.01 \leqq y \leqq 0.65$
$6.0<A<8.0$ According to the experimental data obtained ferromagnetic alloys falling within the alloy composition defined above can possess saturation magnetization strength and anisotropy field strength as high as those of the conventional permanent or ferromagnetic material. In addition, the Curie point is 500° C., or higher for the alloy composition defined above. Thus, it is possible to provide practical and less expensive permanent magnetic alloys which, notwithstanding that the amounts of expensive elements such as rare earth elements and cobalt are reduced relative to presently available permanent magnetic alloys, can possess improved magnetic properties.

The inventors of the present invention have found after extended study that a partial substitution of cobalt with copper in the formula (2) makes the resulting alloy more practical for producing a permanent magnet (body) by sintering through a powder metallurgical process. According to this modification, the present invention alloy can possess a high coercive force regardless of its particle size, and is useful as permanent magnetic alloys of the precipitation-hardening type. This alloy composition can be expressed as follows:

$$R(Ni_xFe_yCo_{1-x-y-z}Cu_z)_A \quad (3)$$

wherein R is one or more of the lanthanide light rare earth elements La, Ce, Pr, Nd and Sm, as well as Y or alloys of these rare earth elements and $0.02 \leqq x \leqq 0.55$
$x/y = 0.07-25.0$
$0.01 \leqq y \leqq 0.65$
$0.02<z<0.30$
$x+y+z<1$
$6.0<A<8.0$ In the formula (3) above, x and y are restricted to 0.02–0.55 and 0.01–0.65, respectively, to ensure magnetic properties including saturation magnetization, anisotropy field strength and Curie point desirable. Particularly, when the ratio of x/y is restricted to 0.07–25.0, both the resulting anisotropy field strength and saturation magnetization are satisfactory. When the Ni and Fe are added substantially in equimolar amounts (that is, in a ratio of about from 0.07 to 1.25 Ni/Fe), the maximum value of Curie point can be obtained. The substitution of Cu for Co within the limitation of the formula (3) does not essentially affect the characteristics of the alloy system according to the formula (2). Thus FIGS. 1–5 for the formula (2) system can essentially be applied to the formula (3) system. Such Ni/Fe equimolar ratio is depicted by a line I—I in FIG. 5. A higher anisotropy field strength means that a higher coercive force can be obtained when the alloy is formed to permanent magnets. A sintered permanent magnet body of such alloy defined by the formula (3) permits a maximum energy product (BH)max value of at least 9.7 MGOe (also vid. FIG. 6).

As is already mentioned, the partial substitution of cobalt with copper is particularly effective in producing subject permanent magnet through a powder metallurgical process. The resulting sintered magnet possesses a high coercive force regardless of its crystal grain, making it useful as permanent magnets of the precipitation hardening type. When z for Cu is smaller than 0.02, a coercive force in such a level as required for the precipitation hardening type permanent magnet cannot be obtained. On the other hand, when z for Cu exceeds 0.30, residual magnetization decreases so much as to make the resulting alloy ineffective for use as a permanent magnet. Practically, the molar ratio of Co(1-x-y-Z) is 0.01 or more, more practically, 0.03 or more.

In addition, if the molar ratio (A) of the transition elements (including copper) to rare earths is less than 6.0, the saturation magnetization is less than 7 KG, i.e., undesirably small. However, if the ratio is more than 8.0, the anisotropy field strength $H_A$ decreases to less than 50 KOe to cause the maximum energy product (BH)max to decrease, which is of less advantage, even though the saturation magnetization is higher than 7 KG.

In a preferred embodiment, the present invention magnetic alloy can be shown by the formula:

$$R(Ni_xFe_yCo_{1-x-y-z}Cu_z)_A \quad (4)$$

wherein R, x/y, z and (x+y+z) are the same as defined in the formula (3), respectively, and $0.02 \leqq x \leqq 0.4$ $0.01 \leqq y \leqq 0.40$ In a more preferred embodiments, subject alloys can be shown by the formula (4) subject to further limited A values:

$$6.2 \leqq A < 8.0 \quad (5)$$

$$6.5 \leqq A < 7.5 \quad (6)$$

By limiting as hereinabove defined, residual magnetization Br and intrinsic coercive force iHc among the required properties for the permanent magnet both enhance, resulting in a preferred permanent magnet with an increased maximum energy product (BH)max value. By further limiting the molar ratio of Ni/Fe (x/y) to a substantially equimolar range, i.e., from 0.07 to 1.25, a more thermally stable permanent magnet provided with a higher Curie point is obtained.

A sintered permanent magnetic body defined by the formula (5) permits a (BH)max value of 14 MGOe or higher, while the body defined by the formula (6) permits a (BH)max value of 20 MGOe or higher according to preferred embodiments of the invention, respectively (vid. FIG. 6).

According to the present invention, therefore, an improved permanent magnetic material can be obtained. However, when the molar ratio (A) is on the higher side within the range defined above, an Fe-Co alloy phase having the face-centered cubic crystal structure is sometimes formed in the process of melting and casting of the present invention alloy. This formation is at least dependent on the ratio of Ni to Fe. The precipitation of this alloy phase markedly deteriorates magnetic properties of the resulting magnetic alloy. In order to prevent the precipitation of this harmful alloy phase, therefore, it is preferable to incorporate at least one of Mn, Cr, V, Ti, Mo, Nb, Zr, W, Ta and Hf in total in an amount of from 0.001 mole to 0.2 mole per mol of the total molar amount of Ni, Fe, Co and Cu for substituting Ni, Fe, Co and Cu.

When the amount of these substitute elements is less than 0.001 mole per mole of the total molar amount of Ni, Fe, Co and Cu, no substantial effect to prevent the formation of said Fe-Co alloy phase is expected. On the other hand, when the amount of these substitute elements is more than 0.2 mole, the residual magnetization deteriorates, resulting in degradation of magnetic properties. In addition, the Curie point also decreases, resulting in less thermal stability.

Preferably, at least one of Mn, Cr, Ti, Zr, Ta, Nb and Hf, more preferably at least one of Mn, Ti, Zr, Ta, Nb and Hf, still more preferably at least one of Mn, Ti, Zr and Hf may be incorporated in an amount of 0.001–0.2 mole per mole of the total molar amount of Ni, Fe, Co and Cu.

The permanent magnet of the present invention may generally be manufactured by the following steps: melting, coarse grinding, finely pulverizing, compacting in a magnetic field, sintering and aging. Preferably, the permanet magnetic alloy of the present invention is first melted by means of high frequency melting of arc-button melting, for example, at a temperature of 1300°–1600° C. in an inert gas atmosphere. The coarse grinding is carried out by means of a steel mortar or roll mill, for example, so as to reduce the particle size to through 35 mesh or finer. The particles are then subjected to pulverizing by means of a ball mill, vibratory mill or jet mill together with an organic medium so as to reduce the particle diameter to around 2–20 μm. The resulting powder is compacted in magnetic field with a pressing machine provided with a die. The strength of the magnetic field is usually 8–20 KOe and the pressure is 1–20 ton/cm$^2$. The resultant green compact is then sintered in an inert gas atmosphere, such as of He, Ar or in a vacuum at a temperature approximately ranging from 1050° to 1250° C. The aging is carried out at a temperature of 400°–900° C.

Preferably, the permanent magnetic alloy of the present invention is manufactured in the following manner: The starting material is melted by way of arc button melting preferably under an Ar atmosphere at about 1500° C. in order as possible as to avoid contamination of the impurity. The resultant mass is coarsely ground to a coarse particles less than 35 mesh under an Ar flow for avoiding oxidation, which coarse particles are then finely comminuted to a fine powder having a particle size of 2–7 μm through a ball milling in an organic solvent. The resultant fine powder is compacted to form a compact by applying a pressure of about 5 T/cm$^2$ in a magnetic field of 10–15 KOe, which compact is then sintered in an Ar atmosphere at about 1100°–1200° C. for two hours subsequently aged at a temperature ranging from 750° to 850° C. for 3–10 hours. This preferred manner provides a particularly significant permanent magnet.

If necessary, as is well known in the art, prior to compacting, the particles of the alloy may be bonded together with a conventional binder, such as organic resin or plastic binder. A metal binder in the powder form may be used. Such manner of preparing a permanent magnet is particularly advantageous in case where the alloy composition includes no copper i.e. in systems $R(Ni_xFe_y)_A$ or $R(Ni_xFe_yCo_{1-x-y})_A$ which are in particular relationship with the present invention in light of Ni-Fe components. In such case, no sintering and aging procedures after compacting procedure in the magnetic field are necessary. However, in the alloy of the present invention, i.e., R-Ni-Fe-Co-Cu alloy system, it is preferred to compact and sinter without no additional binder to form a sintered permanent magnet as this measure provides a higher density of the sintered magnet resulting in an improved permanent magnet.

Variations in the method of making the permanent magnet alloys of the present invention will be obvious to those skilled in the art.

The surprising and unexpected results obtainable with permanent alloy magnets including iron and nickel are shown in the attached drawings. The compositions shown in FIGS. 1 to 5 are disclosed and claimed in our aforesaid U.S. patent application Ser. No. 411,277.

Figure 1:
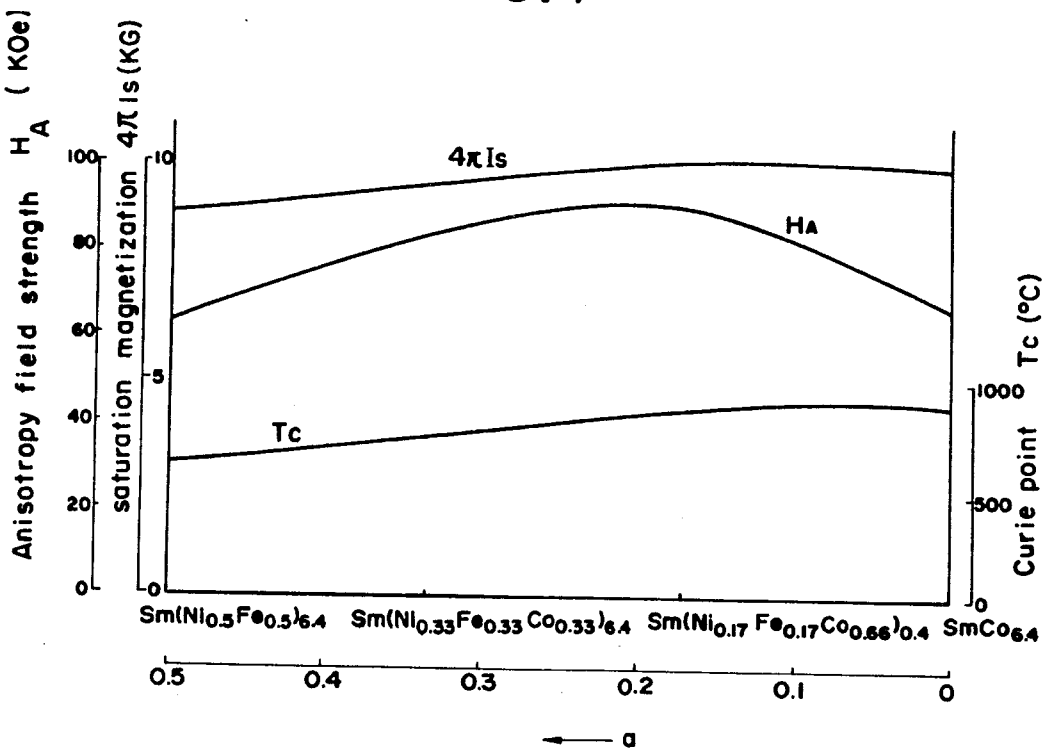
FIG. 1 is a graph showing experimental data on saturation magnetization ($4\pi Is$—KG), anisotropy magnetic field strength ($H_A$—KOe) and Curie point ($T_c$—°C.) with respect to the alloy composition of $Sm(Ni_aFe_aCo_{1-2a})_{6.4}$ in which a varies from zero to 0.5.

Saturation magnetization, anisotropy field strength and Curie point were measured and the results are summarized in FIG. 1 with respect to the alloy compositions used. These properties are important in evaluating the utility of magnetic material. In this case Sm was used as the rare earth element. The alloy composition used can be shown by the formula $Sm(Ni_aFe_aCo_{1-2a})_{6.4}$, in which the amount a was varied from zero to 0.5, changing the alloy composition from $SmCo_{6.4}$ (a=0) to $Sm(Ni_{0.5}Fe_{0.5})_{6.4}$ (a=0.5). The latter composition corresponds to that obtained when equal amounts of $SmNi_{6.4}$ and $SmFe_{6.4}$ are combined. The change in alloy composition was carried out by changing the amount of Co to be added to an alloy composition which contains Ni and Fe in equimolar amounts, as shown by the line I—I in FIG. 5.

FIG. 1 shows the results obtained when Sm was used as the rare earth metal which is the most preferred rare earth and may be commercially available one having purity of 99.9% by weight. However, Sm-base alloys with Y, La, Ce, Pr and/or Nd may advantageously be employed. For instance Ce may be substituted for Sm up to 0.3 mol per one mol Sm. Such minor substitution for Sm is advantageous in view of material cost and natural resources. Among Sm-base alloy with Y, La, Ce, Pr and/or Nd, Sm-Ce alloy is preferred.

As is apparent from FIG. 1, the saturation magnetization strength is 8 KG or higher over the whole range of alloy composition. Since the conventional mass-produced ferrite magnet usually possesses a saturation magnetization strength of about 4 KG, the saturation magnetization of the magnitude of 8 KG or higher is high enough to consider the alloy of this type applicable as permanent magnetic material.

The anisotropy field strength shows the peak value of about 90 KOe not at the marginal points of alloy composition, i.e. $Sm(Ni_{0.5}Fe_{0.5})_{6.4}$ and $SmCo_{6.4}$, but around the point where the alloy composition contains Ni, Fe and Co in equimolar amounts or where a little more Co is contained. In addition, the anisotropy field strength is higher than 50 KOe over the whole range of alloy composition. This suggests that R-Ni-Fe and R-Ni-Fe-Co alloy compositions may be used as permanent magnetic material with a high coercive force.

The Curie point for the alloy composition is 500° C. or higher, which is satisfactory for a practical permanent magnetic alloy. This also suggests that the alloy composition, i.e. R-Ni-Fe and R-Ni-Fe-Co alloys, may be used as permanent magnetic material.

Figure 2:
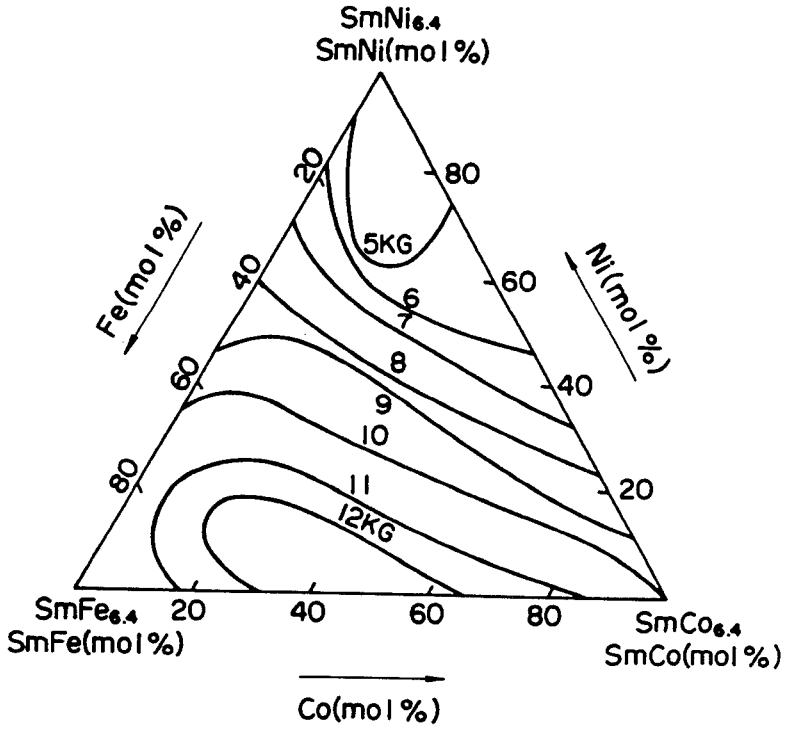
FIGS. 2, 3 and 4 are graphs showing experimental data on saturation magnetization (KG), anisotropy magnetic field strength (KOe) and Curie point (°C.), respectively, on a ternary composition diagram for the alloy of $Sm(Ni_xFe_yCo_{1-x-y})_{6.4}$.
Figure 3:
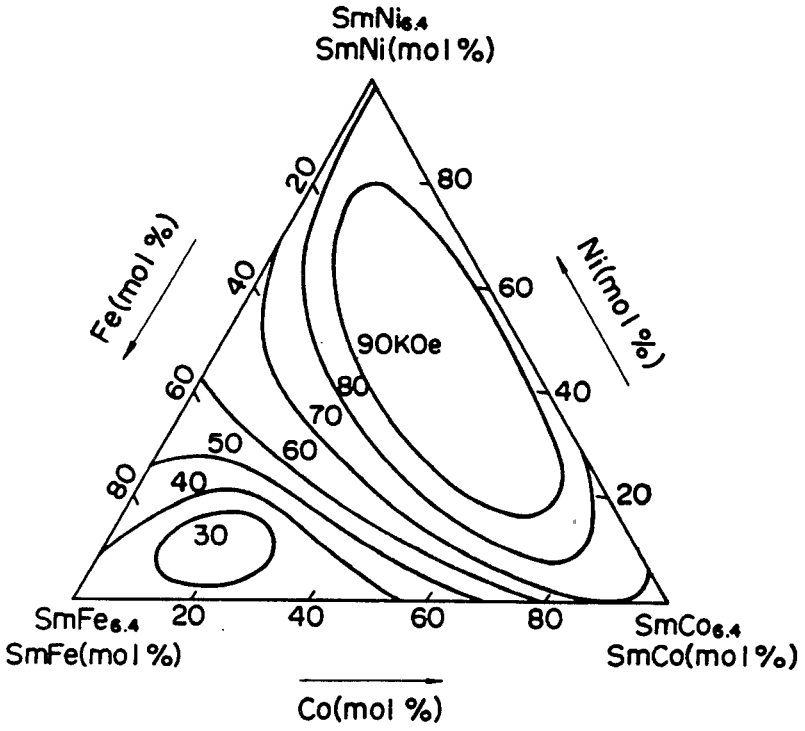
Figure 4:
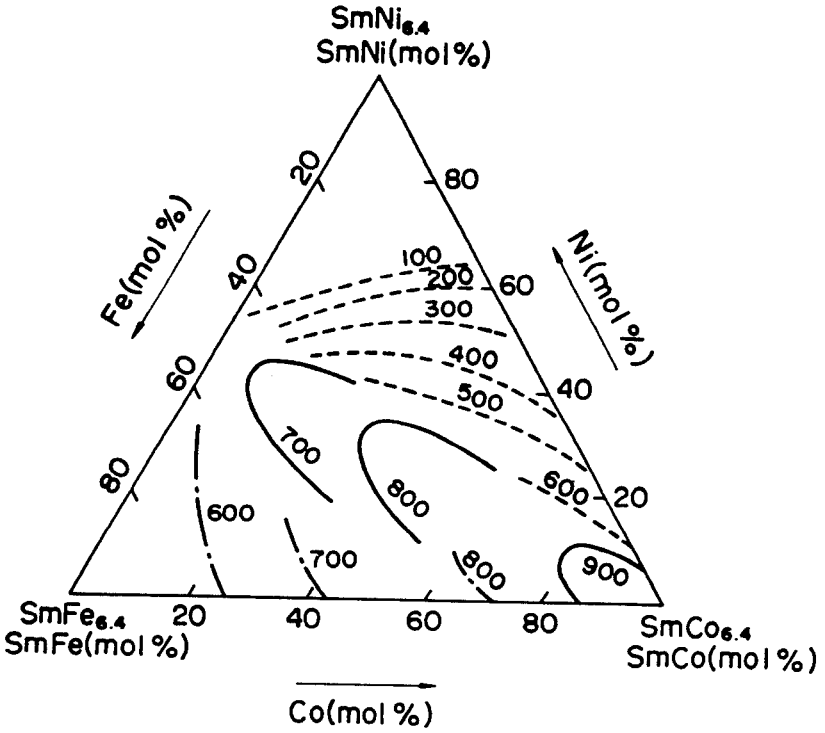

Next, another series of experiments were carried out and saturation magnetization strength, anisotropy field strength and Curie point (the Curie point of the $TbCu_7$ type crystal structure) were measured and the results are shown with respect to the employed alloy composition of $Sm(Ni_xFe_yCo_{1-x-y})_{6.4}$ in FIGS. 2, 3 and 4, respectively.

As is apparent from FIG. 2, the saturation magnetization is 5 KG or higher over the whole range of alloy composition except for over an area near the vertex for Ni. Since these values of saturation magnetization are all equal to or higher than that of the conventional ferrite magnet, the alloy composition of this type is considered promising as a permanent magnet. It is significant that contour lines are extending parallel with an Ni/Fe equimolar line I—I as shown in FIG. 5.

FIG. 3 shows that anisotropy field strength is 50 KOe or higher over the whole range of the alloy composition except for an area near the vertex for Fe, in contrast with that of the saturation magnetization shown in FIG. 2, which fact, however, promises as a permanet magnet with a high coercive force. Particularly, an area having an anisotrophic field strength of 90 KOe or more within a compositional region containing Ni, Fe and Co as transitional elements has been found. This fact implies that a permanent magnet having a significantly high coercive force can be obtained by employing such an alloy.

In addition, Curie point should desirably be 500° C. or higher for practical permanent magnetic alloys. Therefore, the data shown in FIG. 4 suggest that the alloy composition corresponding to an area adjacent to the nickel scale line should be deleted from further consideration as a practical material.

Figure 5:
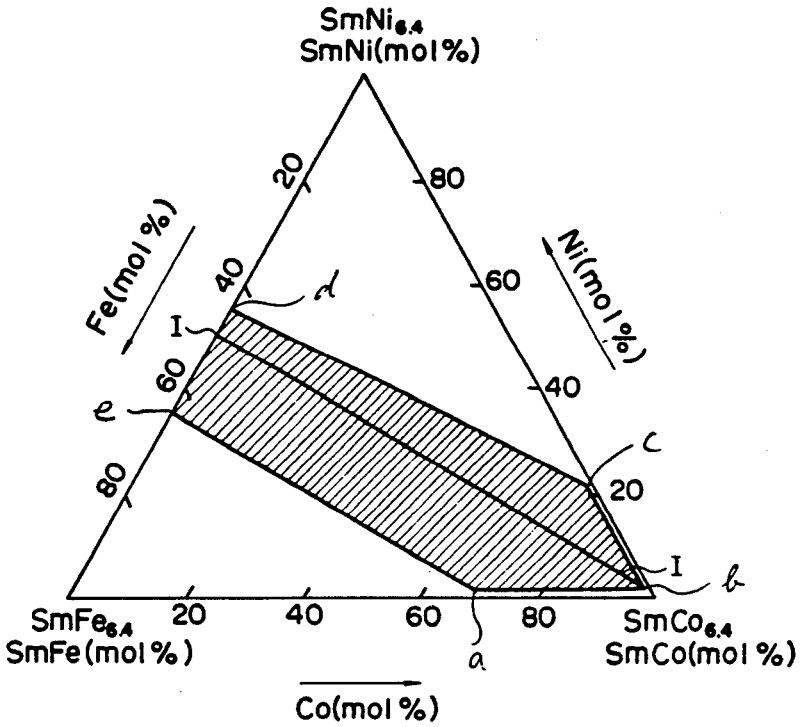
FIG. 5 is a ternary composition diagram for the alloy of $Sm(Ni_xFe_yCo_{1-x-y})_{6.4}$, indicating with a hatched area the alloy composition falling within $0.02 \leqq x \leqq 0.55$, $x/y = 0.07–25.0$ and $0.01 \leqq y \leqq 0.65$.
Figure 6:
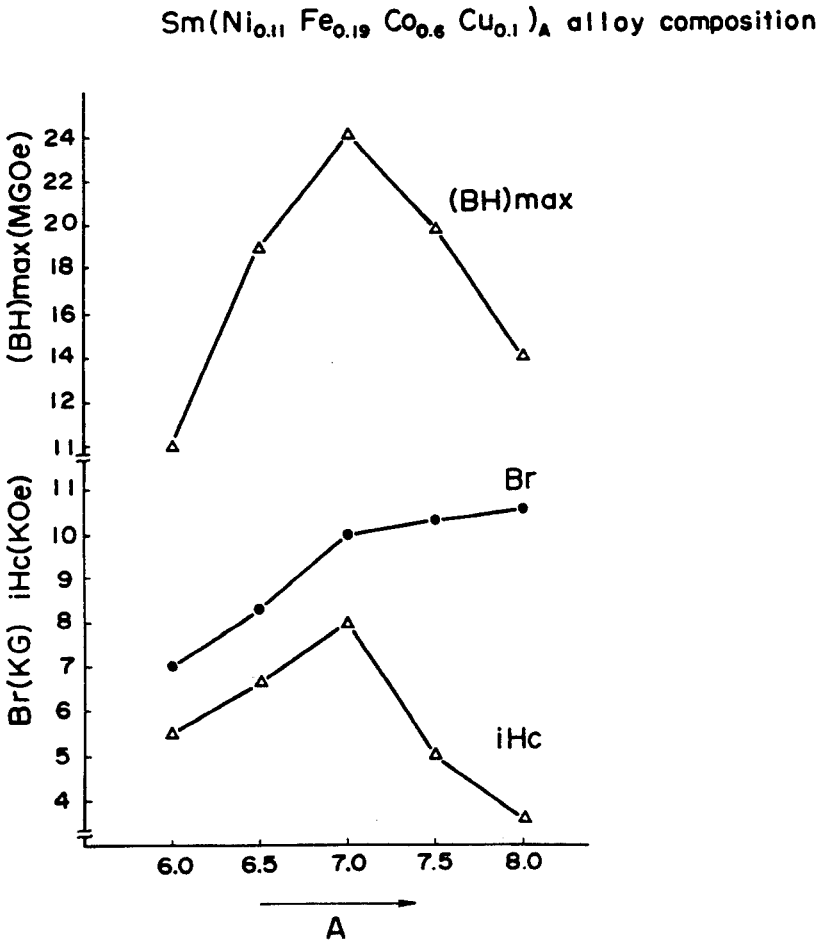
FIG. 6 is a graph plotting experimental values of residual magnetization (Br), intrinsic coercive force (iHc) and maximum energy product ((BH)max) with respect to the alloy composition of $Sm(Ni_{0.11}Fe_{0.19}Co_{0.6}Cu_{0.1})_A$ in which the molar ratio A varies from 6.0 to 8.0.

In view of the experimental data shown in FIGS. 2, 3 and 4, therefore, the alloy composition which has possibility of being used as permanent magnetic material can be defined as shown with a shaded area in FIG. 5. The shaded area is defined by five points a–e in FIG. 5, each point representing (x,y): a (0.02, 0.3), b (0.02, 0.01), c (0.22, 0.01), d (0.55, 0.45) and e (0.35, 0.65). Each corresponding x/y ratio amounts: a: 0.07, b: 2.00, C: 22.0, d: 1.22 and e: 0.54.

Incorporation of Cu by substituting Co in the alloy composition $R(Ni_xFe_yCo_{1-x-y})_A$ to form an alloy composition $R(Ni_xFe_yCo_{1-x-y-z}Cu_z)_A$ is useful for making a practical permanent magnet (body) through a powder metallurgical process, particularly making a fine powder magnet with single domain particles. Within an Cu amount of $0.02 \leqq Z \leqq 0.30$, no deterioration in the magnetic properties due to the decrease in residual magnetization Br and intrinsic coercive force iHc is observed nor the deterioration of thermal stability due to the decrease in Curie point. If the Cu molar ratio Z is less than 0.02 the coercive force is too low, on the other hand if Z is larger than 0.3 residual magnetization Br is reduced even though coercive force increases resulting in no permanent magnet for practical use.

FIG. 6 shows magnetic properties of an alloy composition $Sm(Ni_{0.11}Fe_{0.19}Co_{0.6}Cu_{0.1})_A$ with varying amounts of the molar ratio A. As is apparent from the graphs shown therein, when the molar ratio falls within the range defined in the present invention, satisfactory magnetic properties including residual magnetization, intrinsic coercive force and maximum energy product can be obtained.

The molar ratio A is limited to a range $6.0<A<8.0$ as significant properties as a permanent magnetic material or a sintered permanent magnetic body for practical use cannot be obtained at outside of such range, the requisite properties include: $Br \geqq 7$ KG, $Hc \geqq 3.5$ Koe and $(BH)_{max} \geqq 9.7$ MGOe.

The molar ratio x for Ni is limited to a range $0.02 \leqq x \leqq 0.55$ as follows: x less than 0.02 renders no sufficiently high coercive force whereas x higher than 0.55 results in a low Br value less than 7 KG.

The molar ratio y for Fe is limited to a range $0.01 \leqq y \leqq 0.65$ as y less than 0.01 results in a reduced Br value whereas y higher than 0.65 permits no higher coercive force than 3.5 KOe.

The Ni/Fe ratio x/y is limited to a range of 0.07–25.0 as an x/y ratio less than 0.07 causes coercive force to reduce markedly whereas an x/y ratio higher than 25.0 results in a reduced maximum energy product $(BH)_{max}$ less than 9.7 MGOe due to a reduced Br value of less than 7 KG despite a high coercive force. The inventive alloy composition includes Co as a requisite component thus stands: $x+y+z<1$. Practically Co is 0.01 or more, more practically 0.03 or more.

The present invention will further be explained by way of working examples, which are presented merely for the purpose of illustration of the present invention and are not intended to limit the present invention in any way.

EXAMPLE 1

An alloy having the composition of $Sm(Ni_{0.2}Fe_{0.2}Co_{0.5}Cu_{0.1})_{6.4}$ was melted with the high frequency induction furnace in an argon atmosphere. After coarsely grinding with a steel mortar, the resulting particles were pulverized together with hexane in a ball mill to yield a particle diameter of less than 7 μm. The thus obtained finely divided particles were compacted with a die at a pressure of 5 ton/cm$^2$ in a magnetic field of 12 KOe. The green compact was sintered at a temperature of 1150° C. for one hour and then aged at a temperature of 800° C. for two hours.

The following magnetic properties were obtained on the thus obtained sintered magnetic alloy.

| | | | |
|---|---|---|---|
| Br | 8100 G | iHc | 4900 Oe |
| (BH)max | 12 MGOe | density | 8.50 g/cm$^3$ |

EXAMPLE 2

Example 1 was repeated to provide a green compact except that the alloy composition was $Sm(Ni_{0.35}Fe_{0.35}Co_{0.2}Cu_{0.1})_{6.4}$. The resulting green compact was sintered at a temperature of 1050° C. for one hour and then aged at a temperature of 800° C. for two hours.

The following magnetic properties were obtained.

| | | | |
|---|---|---|---|
| Br | 7700 G | iHc | 3500 Oe |
| (BH)max | 9.7 MGOe | density | 8.32 g/cm$^3$ |

The molar ratio A (6.4) was changed to 6.8 otherwise under the same conditions resulting in: Br 7850 G, (BH)max 10.7 MGOe, iHc 3500 Oe, density 8.32 g/cm$^3$.

EXAMPLE 3

Example 1 was repeated to provide a green compact except that the alloy composition was $Sm_{0.9}Y_{0.1}(Ni_{0.05}Fe_{0.05}Co_{0.78}Cu_{0.12})_{7.0}$. The green compact was sintered at a temperature of 1220° C. for one hour, then subjected to solution treatment at a temperature of 1190° C. for two hours and quenched. After aging at a temperature of 800° C. for two hours, the following magnetic properties were obtained.

| | | | |
|---|---|---|---|
| Br | 9650 G | iHc | 5500 Oe |
| (BH)max | 22.5 MGOe | density | 8.53 g/cm$^3$ |

EXAMPLE 4

Example 3 was repeated except that the alloy composition was $Sm_{0.9}Y_{0.1}(Ni_{0.1}Fe_{0.1}Co_{0.68}Cu_{0.12})_{7.0}$. The following magnetic properties were obtained.

| | | | |
|---|---|---|---|
| Br | 9650 G | iHc | 5800 Oe |
| (BH)max | 22.5 MGOe | density | 8.46 g/cm$^3$ |

EXAMPLE 5

Example 1 was repeated to provide a green compact except that the alloy composition was $Sm_{0.6}Pr_{0.4}(Ni_{0.1}Fe_{0.1}Co_{0.7}Cu_{0.1})_{7.0}$. The resulting green compact was sintered at a temperature of 1190° C. for two hours. After sintering the aging treatment was applied at a temperature of 800° C. for two hours. The following magnetic properties were obtained.

| | | | |
|---|---|---|---|
| Br | 9730 G | iHc | 3000 Oe |
| (BH)max | 16.5 MGOe | density | 8.41 g/cm$^3$ |

EXAMPLE 6

In this example, Example 3 was repeated except that the alloy composition was $Sm(Ni_{0.2}Fe_{0.05}Co_{0.65}Cu_{0.1})_{7.0}$. The resulting sintered permanent magnet possessed the following properties.

| | | | |
|---|---|---|---|
| Br | 8100 G | iHc | 5700 Oe |
| (BH)max | 15.9 MGOe | density | 8.40 g/cm$^3$ |

EXAMPLE 7

An alloy composition $Sm(Ni_{0.08}Fe_{0.18}Co_{0.64}Cu_{0.1})_{7.0}$ was compacted in the same manner as Example 1. Then the resultant compact was sintered for 1 hour at 1200° C., subsequently subjected to a solution heat treatment for 1190° C. ×2 hous then quenched. The resultant mass was aged for 4 hours at 800° C. The following magnetic properties were obtained on the resultant.

| | | | |
|---|---|---|---|
| Br | 10600 G | iHc | 6000 Oe |
| (BH)max | 27.0 MGOe | density | 8.51 g/cm$^3$ |

EXAMPLE 8

In this example, Example 1 was repeated to provide a green compact except that the alloy composition was $Sm(Ni_{0.25}Fe_{0.25}Co_{0.39}Cu_{0.1}Mn_{0.01})_{7.0}$. The resulting green compact was sintered at a temperature of 1150° C. for one hour and then aged at a temperature of 800° C. for two hours. The following magnetic properties were obtained.

| | | | |
|---|---|---|---|
| Br | 8700 G | iHc | 6100 Oe |
| (BH)max | 18.0 MGOe | density | 8.45 g/cm$^3$ |

EXAMPLE 9

In this example, Example 1 was repeated to provide a green compact except that the alloy composition was $Sm(Ni_{0.2}Fe_{0.2}Co_{0.48}Cu_{0.1}Mn_{0.02})_{7.0}$. The resulting green compact was sintered at a temperature of 1170° C. for one hour and then aged at a temperature of 800° C. for two hours. The following magnetic properties were obtained.

| | | | |
|---|---|---|---|
| Br | 8900 G | iHc | 5600 Oe |
| (BH)max | 18.5 MGOe | density | 8.44 g/cm$^3$ |

EXAMPLE 10

Example 1 was repeated to provide a green compact except that the alloy composition of $Sm(Ni_{0.2}Fe_{0.2}Co_{0.48}Cu_{0.1}Mn_{0.007}Ti_{0.013})_{7.0}$. The resultant green compact was sintered at 1170° C. for 1 hour then aged at 800° C. for 2 hours. The following magnetic properties were obtained.

| | | | |
|---|---|---|---|
| Br | 9100 G | iHc | 5700 Oe |
| (BH)max | 19.5 MGOe | density | 8.46 g/cm$^3$ |

EXAMPLE 11

An alloy composition $Sm(Ni_{0.07}Fe_{0.23}Co_{0.59}Cu_{0.11}Hf_{0.01}Nb_{0.02})_{6.98}$ was made to a sintered magnet in the same manner as Example 7 resulting in:

| | | | |
|---|---|---|---|
| Br | 10650 G | iHc | 6200 Oe |
| (BH)max | 27.3 MGOe | density | 8.45 g/cm$^3$ |

EXAMPLE 12

An alloy composition $Sm(Ni_{0.09}Fe_{0.27}Co_{0.56}Cu_{0.06}Zr_{0.007}Ta_{0.007}Mn_{0.006})_{7.2}$ was compacted in the same manner as Example 1. The green compact was sintered at 1190° C. for 2 hours then solution treated at 1170° C. for 2 hours and subsequently quenched. Aging was applied at 850° C. for 3 hours resulting in:

| | | | |
|---|---|---|---|
| Br | 11000 G | iHc | 7200 Oe |

-continued

| | | | |
|---|---|---|---|
| (BH)max | 29.5 MGOe | density | 8.44 g/cm$^3$ |

Thus, as is apparent from the foregoing, according to the present invention, a permanent magnetic material of the rare earth element-transition metal intermetallic compound type can be obtained. Particularly because of the fact that the present invention alloy contains both Fe and Ni in approximately equimolar amounts, it can successfully form a sintered body of the $TbCu_7$ type crystal structure, which yields a practical permanent magnetic material after application of aging treatment. In addition, since the amounts of resources-limited and expensive elements such as rare earth metals and cobalt can successfully and relatively be reduced while magnetic properties of the resulting alloy are markedly improved, the present invention can provide a great deal of economical and technological advantages.

What is claimed is:

1. A permanent magnetic article having a maximum energy product of 20 MGOe or higher and produced by aging a sintered permanent magnetic body at a temperature of 750°- 850° C., the sintered permanent magnetic body consisting essentially of an intermetallic compound shown by the formula:

$$R(Ni_xFe_yCo_{1-x-y-z}Cu_z)_A$$

wherein R is at least one element selected from the group consisting of Y, La, Ce, Pr, Nd and Sm, and $0.02 \leqq x \leqq 0.55$ $x/y = 0.07\text{-}25.0$ $0.01 \leqq y \leqq 0.65$ $0.02 \leqq z \leqq 0.30$ $x+y+z<1$ $6.0<A<8.0$ and having a crystal structure substantially of the $TbCu_7$ type with a Curie point of no less than 800° C.

2. A sintered permanent magnetic body defined in claim 1, in which:

$0.02 \leqq x \leqq 0.40$ $0.01 \leqq y \leqq 0.40$.

3. A sintered permanent magnetic body as defined in claim 2, in which:

$6.2 \leqq A < 8.0$.

4. A sintered permanent magnetic body as defined in claim 2, in which:

$6.5 \leqq A < 7.5$.

5. A sintered permanent magnetic body as defined in claim 3, in which Ni and Fe are incorporated in an x/y ratio of about from 0.07 to 1.25.

6. A sintered permanent magnetic body as defined in claim 1, in which R is Sm or a Sm alloy.

7. A sintered permanent magnetic body as defined in claim 1, in which R is Y or a Y alloy.

8. A sintered permanent magnetic body as defined in claim 1, in which R is an alloy of Sm with at least one of Y, La, Ce, Pr and Nd.

9. A sintered permanent magnetic body as defined in claim 1, in which R is an alloy of Sm with at least one of Ce, Pr and Y.

10. A sintered permanent magnetic body as defined in claim 1, in which the molar ratio for Co(1-x-y-z) is 0.01 or more.

11. A sintered permanent magnetic body as defined in claim 1, in which the molar ratio for Co(1-x-y-z) is 0.03 or more.

12. A sintered permanent magnetic body as defined in any one of claims 1–5, in which the molar ratio for Co(1-x-y-z) is 0.2 or more.

13. A permanent magnetic article as defined in claim 1 having a maximum energy product of at least 22.5 MGOe.

14. A sintered permanent magnetic body consisting essentially of an intermetallic compound shown by the formula:

$$R(Ni_xFe_yCo_{1-x-y-z}Cu_z)_A$$

wherein R is at least one element selected from the group consisting of Y, La, Ce, Pr, Nd and Sm, and $0.02 \leqq x \leqq 0.55$ $x/y = 0.07–25.0$ $0.01 \leqq y \leqq 0.65$ $0.02 \leqq z \leqq 0.30$ $x+y+z<1$ $6.0<A<8.0$ and having a crystal structure substantially of the $TbCu_7$ type with a Curie point of no less than 800° C., wherein 0.001–0.2 mole of the transition metals of Ni, Fe, Co and Cu per mole of the total molar amount of Ni, Fe, Co and Cu in said formula is substituted by at least one substitute element selected from the group consisting of Mn, W, Ta and Hf.

15. A sintered permanent magnetic body as defined in claim 14, in which said substitute element is at least one selected from the group consisting of Mn, Ta, and Hf.

16. A sintered permanent magnetic body as defined in claim 15, in which said substitute element is at least one selected from the group consisting of Mn, and Hf.

17. A permanent magnetic article produced by aging the sintered permanent magnetic body as defined in claim 14 at a temperature of 750°–850° C.

18. A permanent magnetic article as defined in claim 17 having a maximum energy product of at least 20 MGOe.

19. A permanent magnetic article as defined in claim 17 having a maximum energy product of at least 22.5 MGOe.

* * * * *